US009719326B2

(12) United States Patent
Jones et al.

(10) Patent No.: US 9,719,326 B2
(45) Date of Patent: Aug. 1, 2017

(54) SWITCH BETWEEN REDUNDANT CONTROL SYSTEMS FOR A SUBSURFACE SAFETY VALVE

(71) Applicant: Baker Hughes Incorporated, Houston, TX (US)

(72) Inventors: Brett C. Jones, Broken Arrow, OK (US); Samuel C. Kucera, Tulsa, OK (US); Michael L. Hair, Tulsa, OK (US); Clifford H. Beall, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 740 days.

(21) Appl. No.: 14/078,152

(22) Filed: Nov. 12, 2013

(65) Prior Publication Data

US 2015/0129196 A1 May 14, 2015

(51) Int. Cl.
*E21B 34/10* (2006.01)

(52) U.S. Cl.
CPC ..... *E21B 34/10* (2013.01)

(58) Field of Classification Search
USPC .... 91/508; 166/332.1, 332.7, 319, 321, 324, 166/325, 375
See application file for complete search history.

(56) References Cited

U.S. PATENT DOCUMENTS

| | | | | |
|---|---|---|---|---|
| 2,669,842 | A * | 2/1954 | Slomer | F15B 20/004 60/405 |
| 4,621,695 | A | 11/1986 | Pringle | |
| 4,838,355 | A | 6/1989 | Leismer et al. | |
| 5,310,004 | A | 5/1994 | Leismer | |
| 7,347,270 | B2 | 3/2008 | McMillan et al. | |
| 7,762,335 | B2 * | 7/2010 | Anderson | E21B 34/10 166/321 |
| 7,878,252 | B2 | 2/2011 | Smith et al. | |
| 7,954,552 | B2 | 6/2011 | Mandrou et al. | |
| 8,360,158 | B2 | 1/2013 | Mandrou et al. | |
| 2009/0050333 | A1 | 2/2009 | Smith et al. | |

* cited by examiner

*Primary Examiner* — David Bagnell
*Assistant Examiner* — Ronald Runyan
(74) *Attorney, Agent, or Firm* — Steve Rosenblatt

(57) ABSTRACT

Two control systems are provided to run in parallel between a surface location and the final controlled element, in this case a subsurface safety valve. The primary control circuit is controlling until a predetermined signal is given to the secondary control line which has the effect of actuating the valve a single time against the force of a bias or a shear pin that breaks. The movement of a shuttle in the housing due to the predetermined signal being provided in the secondary line puts the secondary control system in the position of running the tool. The primary system is valved off and cannot return into service. There are just two lines into and out of the housing to make the valve operate at the desired location. A test port is provided for surface testing.

22 Claims, 4 Drawing Sheets

SWITCH BETWEEN REDUNDANT CONTROL SYSTEMS FOR A SUBSURFACE SAFETY VALVE

FIELD OF THE INVENTION

The field of the invention is hydraulic switch valves and more particularly switch valves for switching between redundant hydraulic circuits extending to a subterranean location without an auxiliary actuation line.

BACKGROUND OF THE INVENTION

Hydraulic valves to reconfigure hydraulic circuits have been used in the past. These valves typically reconfigure port alignment and in so doing reconfigure a hydraulic circuit to push a piston in opposed direction for a variety of purposes. Typically these valves have a ported internal shuttle that responds to pressure in an actuation line that overcomes a return spring so that the ports in the shuttle align with different housing ports to reconfigure the hydraulic circuit.

In subterranean locations space for control lines to operate tools is at a premium. In the realm of subsurface safety valves operators frequently desire a backup system for hydraulic actuation of the safety valve. One way to do this is to provide redundant control lines so that if an issue develops with a primary control line such as damage or dents from impacts during running in or even worse a line severing there is a backup control system that can be enabled to keep the subsurface safety valve working. The presence of a backup system can prevent the costly removal of the safety valve and the attendant lost production.

U.S. Pat. Nos. 8,360,158B2/7,954,552B2 entitled Overriding a Primary Control Subsystem of a Downhole Tool describes a system to override a primary control subsystem of a down hole tool. These systems incorporate two control systems but they are not independent. The systems are described as a hydraulic loop with a supply line and a return line that can be switched. The preferred embodiment of the present invention incorporates two independent control systems and does not incorporate a hydraulic loop or exhaust to operate the valve. US 20090050333A1 /U.S. Pat. No. 7,878,252B2 entitled Dual Control Line System and Method for Operating Surface Controlled Sub-Surface Safety Valve in a Well describes a system with two control lines to operate one piston. The device necessitates the pressuring of a primary line to open the valve and the pressure relief of a secondary line to close the valve. The preferred embodiment of the present invention does not incorporate a hydraulic loop or exhaust to operate the valve. U.S. Pat. No. 7,347,270B2 entitled Redundant Hydraulic System for Safety Valve describes a redundant hydraulic system for a safety valve that has a mechanism to selectively translate the secondary piston between a first position at which the secondary piston is not responsive to a control stimulus and a second position at which the secondary piston is responsive to the command stimulus. Another mechanism is used to bias the primary piston to move the flow tube. The preferred embodiment of the present invention does not move the primary or secondary pistons between an active or inactive position, but rather uses a switch to deactivate one piston and activate the other. U.S. Pat. No. 4,621,695A entitled Balance Line Hydraulically Operated Well Safety Valve describes a means of negating the effects of hydraulic head on an operating piston by use of a balance line. This valve uses one control line to the top of the piston and is used to operate the piston to open the valve. A second control line runs from the well surface to the bottom of the piston and is used to compensate for the hydraulic head in the first line. The preferred embodiment of the present invention uses a balance line connected to a chamber, which is communicated to the primary control line after the switch is actuated. U.S. Pat. No. 5,310,004A entitled Fail Safe Gas Bias Safety Valve describes a valve that uses a gas chamber to help offset the hydraulic head acting on a piston. The preferred embodiment of the present invention does not rely on a gas pressure to assist the closure of the pistons. U.S. Pat. No. 4,838,355 entitled Dual Hydraulic Safety Valve describes a valve in which a primary piston is connected to a primary control line and the flow tube. The valve has a secondary piston which is connected to the secondary control line and disconnected from the flow tube. There is a means to switch operating systems by disconnecting the first piston from the flow tube and connecting the second piston to the flow tube. The preferred embodiment of the present invention has a primary piston that is connected to the primary hydraulic line and the flow tube. The preferred embodiment of the present invention has a secondary piston that is not connected to the secondary control line but is not prevented from contact with the flow tube. The preferred embodiment of the present invention has two control lines from the wellhead while this patent describes a mechanism that requires three control lines.

In subterranean locations there can be a serious space problem for control lines. When running two redundant control systems from a wellhead to a subterranean tool such as a subsurface safety valve, having to run a third line to actuate the switch valve between the two systems make the installation impractical if not impossible. The present invention addresses this issue with a switch valve that allows one switch from a primary to a secondary control system with no return to the primary system. Further, the valve is configured to have the two main control lines come to it and switch between them without need for an auxiliary line to effect the switchover. Finally, to prevent accidental switching between the control systems which would normally be triggered by simply applying pressure to the secondary line. a safety device is provided so that the application of pressure just once to the secondary control system will not actuate the switch valve inadvertently. Instead, the pressure has to be cyclically applied to the secondary control system several times to ensure that a switch was actually intended. After the predetermined cycles are applied, the switch device then makes the secondary circuit the primary circuit for uninterrupted operation of the safety valve or the subterranean tool being operated. Those skilled in the art will be able to better understand the invention from the description of the preferred embodiment and the associated drawings while recognizing that the full scope of the invention is to be found in the appended claims.

SUMMARY OF THE INVENTION

Two control systems are provided to run in parallel between a surface location and the final controlled element, in this case a subsurface safety valve. The primary control circuit is controlling until a predetermined signal is given to the secondary control line which has the effect of actuating the valve a single time against the force of a bias or a shear pin that breaks. The movement of a shuttle in the housing due to the predetermined signal being provided in the secondary line puts the secondary control system in the position of running the tool. The primary system is valved off and cannot return into service. There are just two lines into and out of the housing to make the valve operate at the desired location. A test port is provided for surface testing of both subsurface safety valve control systems.

DETAILED DESCRIPTION OF THE PREFERED EMBODIMENT

Figure 1:
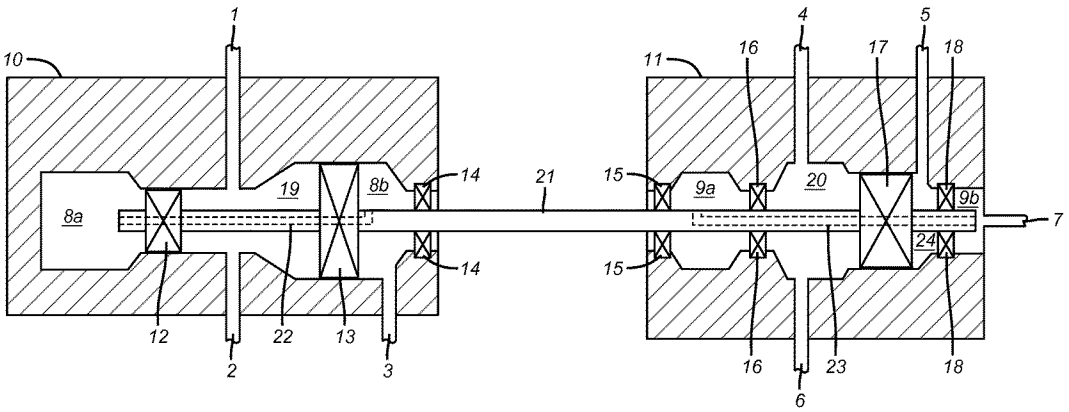
FIG. 1 is the valve shown in the run in position with the primary circuit operating the tool.

The apparatus consists of a shuttle piston (21) contained within a housing or housings (10, 11). Attached to the piston (21) are multiple seals (12, 13, and 17) of various sizes. One set of seals (14) is attached to the primary housing (10). Three sets of seals (15, 16, and 18) are attached to the secondary housing (11). There is a communication port (22) within the piston (21) connecting two chambers (8*a*, 8*b*) in the primary housing (10). Such connection can also be external with a jumper line. There is another communication port (23) within the piston (21) connecting two chambers (9*a*, 9*b*) in the secondary housing (11). Such connection can also be external with a jumper line.

In the initial configuration of the switch shown in FIG. 1, the main primary housing chamber (19) communicates primary hydraulic control fluid pressure through a primary control line between the connection (1) to a hydraulic pump at the surface and a connection (2) to the top of the primary valve control system. The rightmost secondary housing chamber (8*b*) is communicated to the balance line at the bottom of the primary control system via a port (3). The main secondary housing chamber (24) is connected via the secondary control line connected to port (5) by a hydraulic pump at the surface. The rightmost primary housing chamber (9*b*) is communicated to the balance line at the bottom of the secondary control system via a communication port (7). The central chamber (20) is communicated to the top of the secondary valve control system via a port (6). A test port (4) is also connected to (20) so that the secondary control system can be functionally tested before the valve is installed.

In the initial configuration, with no control pressure applied, hydrostatic control line pressure (HCLP) is present in two chambers (19, 24). In the primary chamber (19), HCLP is acting upon a differential area created by two differently-sized seals (12, 13); this differential area biases the piston to the right. In the secondary chamber (24), HCLP is acting upon a differential area of the seal (17) and the outer diameter (OD) of the piston (21). This differential area biases the piston to the left. Therefore, the piston is under neutral forces if the differential areas are equal. If the differential area caused by the primary side seals (12, 13) is greater than that due to the secondary side seal (17) and piston (21) outside diameter, the piston will be biased to the right. A pin, collet, spring, or other mechanism can also be added to bias the piston to the right instead of the use of differential seal areas. Note that only one port (2, 6) connected to the control system of the valve will experience HCLP in this configuration.

Figure 4:
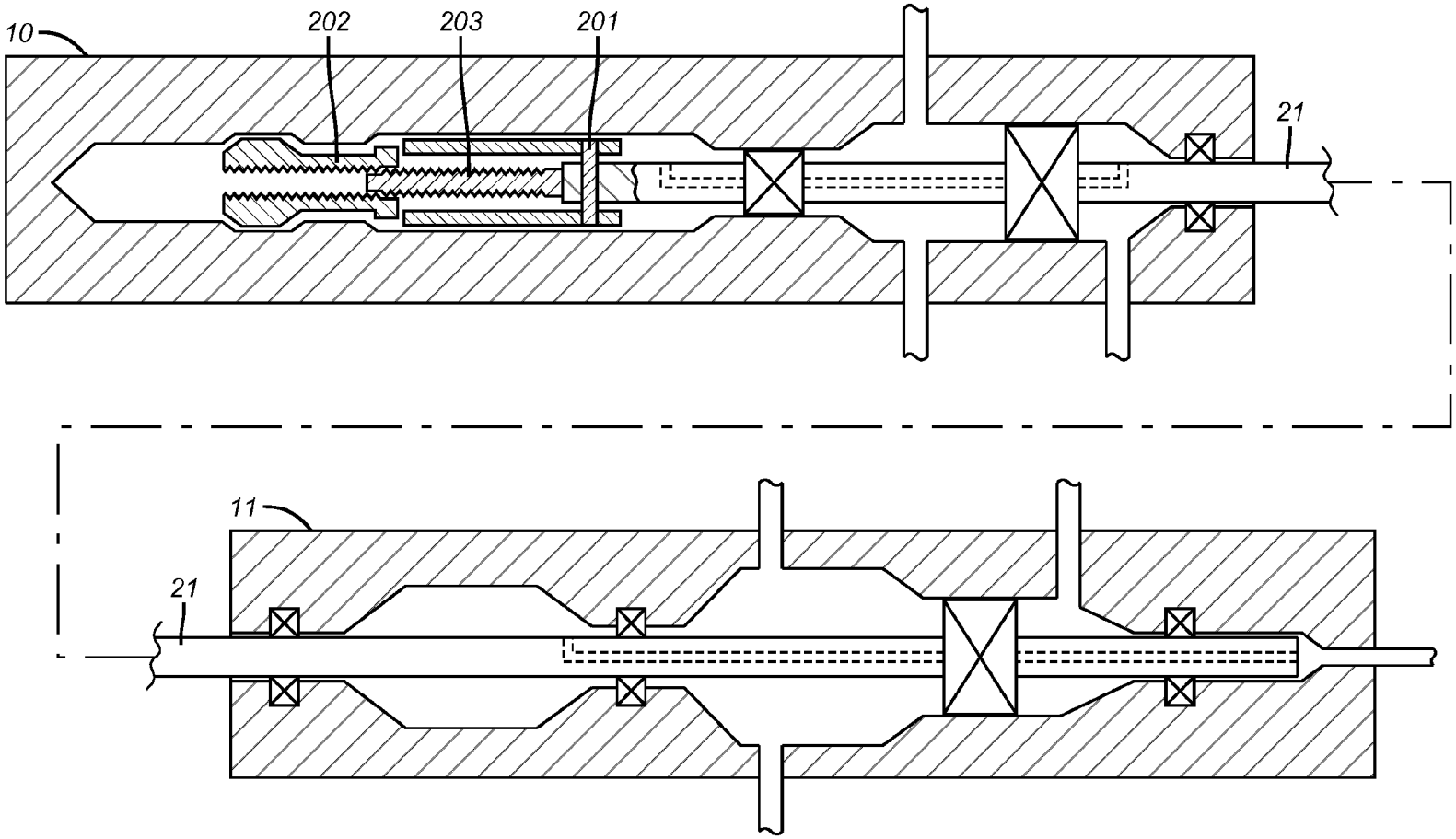
FIG. 4 is another view of FIG. 1 showing the initial fixation of the piston and the locking device for the piston after it has been shifted.

When opening pressure is applied to the primary control line (1), the piston (21) remains biased to the right, and primary control pressure is communicated to the primary control system. If there is a leak in the primary control system balance line (3), it will be communicated via the port (3) into the chambers (8*b*, 8*a*). If this leaked pressure is too great, it will force the piston (21) to shift the left as in FIG. 2. To intentionally move the piston (21) to the shifted position of FIG. 2, such as in the event of failure of the primary hydraulic system (either internal or external to this apparatus), hydraulic pressure is removed from primary control line port (1) and applied to the secondary control line port (5). The difference in areas of seal (17) and the piston (21) results in a net force to the left. The left-most seal (12) will leave its seal bore (25), and the primary control chamber (19) will be communicated with the primary balance line (3) via the other chambers (8*a*, 8*b*) and the communication port (22) within the piston. In the course of shifting, the piston (21) will also move the large secondary seal (17) out of its seal bore (26), thus communicating the secondary control line (5) to the secondary valve control system port (6). At this point, a pin, collet, ratchet, spring, or other mechanism (202, 203), shown in FIG. 4 can be employed to retain the piston in the shifted position, but it is not necessary. Another option is to use a shear pin or other temporary fixation device (201) to hold piston (21) in the initial position of FIG. 1.

Figure 2:
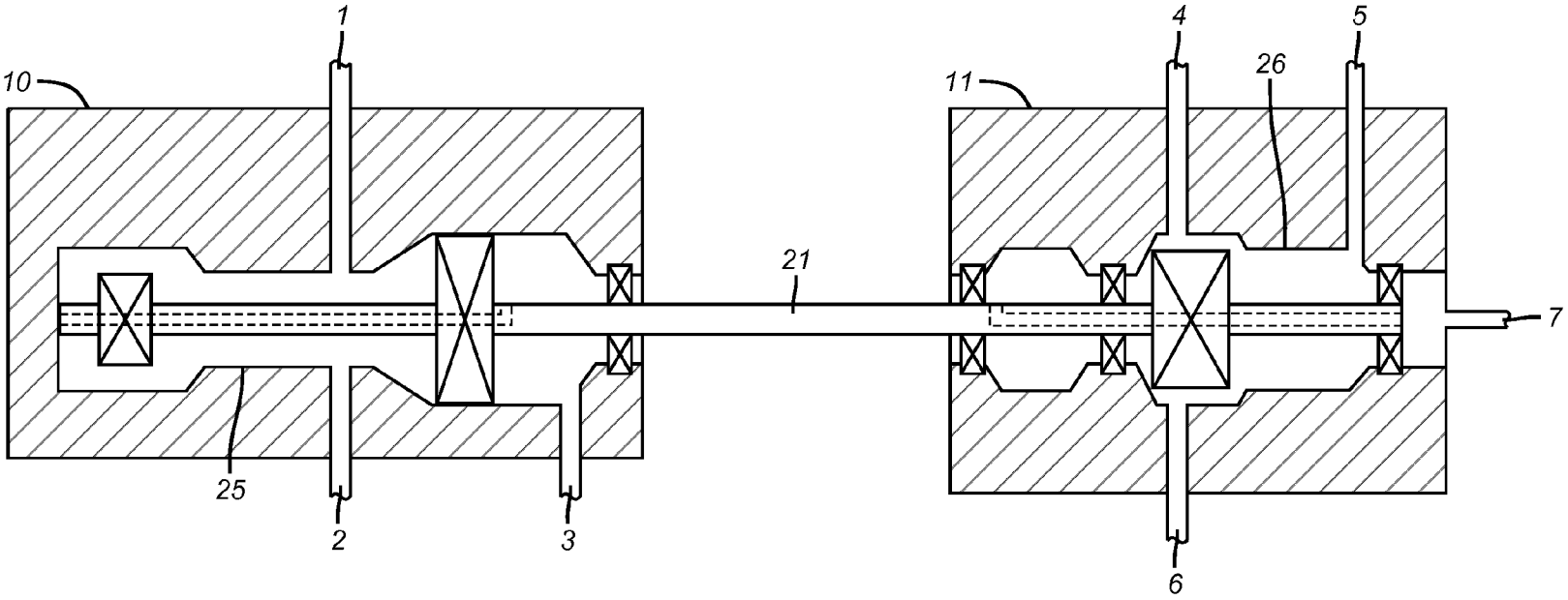
FIG. 2 is the view of FIG. 1 in the shifted position where the backup control system has been put into operation.

Once the piston (21) is shifted as shown in FIG. 2, the valve will continue to operate like a standard balanced line TRSV using the secondary control system (5). If pressure is reapplied to the primary control system (1), it will not actuate the valve, as the tripped piston will communicate any primary pressure to both the top (2) and bottom (3) of the primary control system equally. Additionally, no net force will be applied to the piston (21), since equal forces will be applied to both sides of the seals (12, 13) attached to the piston (21) on the primary side. This switch will allow only the pressure from a single control line to act upon the valve control system, thereby allowing redundant operation without sacrificing setting depth.

Figure 3:
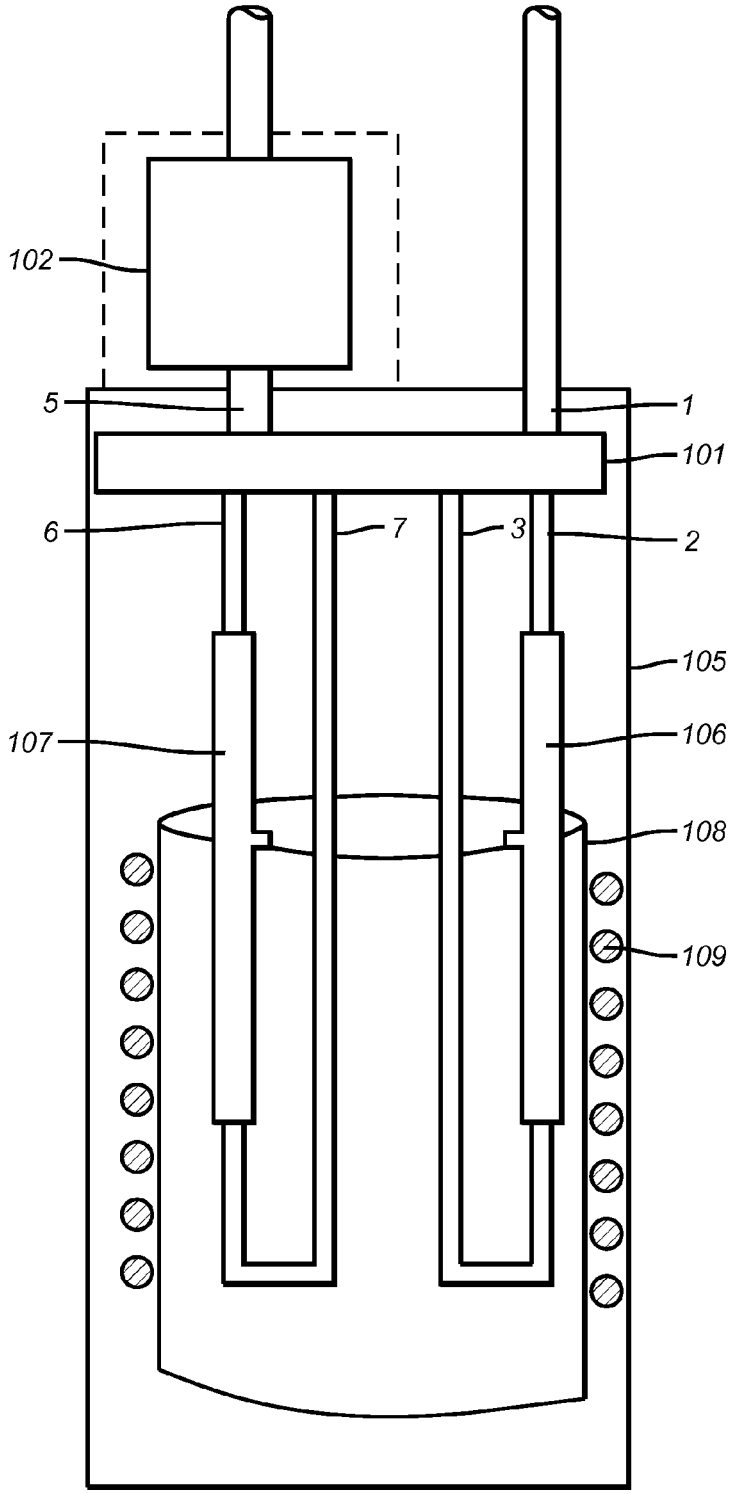
FIG. 3 is a system view showing the two control systems and how they interact with the flow tube of the safety valve.

FIG. 3 further shows a lock device (102) that can be added to line (5) that will avoid inadvertent actuation from simply pressuring up on line (5) as described above. The device (102) can be one of a variety of electrical or mechanical switch devices that respond to a local or remotely generated signal such as electrical, physical, force or acoustical, for example, to open. For example, pressure cycles of application and removal of pressure can be used to selectively open a passage (5) to make the switch to the alternative control system as described above. Also illustrated in FIG. 3 is the flow tube (108) that is acted on by return spring (109) by either primary piston (106) in the main control system or a secondary piston (107) in the secondary control system to further illustrate how the connections on the valve body (101) that is a part of the valve housing (105) interact with the internal components of the safety valve.

Although the preferred embodiment is illustrate to be subsurface safety valve, those skilled in the art will appreciate that the invention can be adapted to other subterranean tools that operate with hydraulic control systems.

The above description is illustrative of the preferred embodiment and many modifications may be made by those skilled in the art without departing from the invention whose scope is to be determined from the literal and equivalent scope of the claims below:

We claim:

1. A valve for engaging a backup hydraulic system to operate a subterranean tool from a primary hydraulic system, comprising:

a subterranean tool having a movable member actuated by a primary piston or a secondary piston;

a valve having two inlets to respectively connect a primary control line and a secondary control line that each extend to the tool from a remote location;

said valve comprising a valve member axially slidable from a first position where said primary control line is in flow communication with said primary piston to a second position where said secondary control line, as a direct result of said valve member moving to said second position, is in communication with said secondary piston by application of pressure in one of said control lines, said application of pressure directly axially sliding said valve member between said positions such that said sliding of said valve member alone puts said primary piston in pressure balance from said primary control line and opens a hydraulic circuit between said secondary control line and said secondary piston for backup operation of the subterranean tool.

2. The valve of claim 1, wherein:

application of pressure to said secondary control line moves said valve member to said second position.

3. The valve of claim 2, wherein:

application and removal of pressure for a predetermined number of cycles moves said valve member to said second position.

4. The valve of claim 2, wherein:

application of pressure to said second control line moves said valve member such that said second control line is put into fluid communication with said secondary piston.

5. The valve of claim 2, wherein:

application of a signal to a switch mounted to said secondary control line allows hydraulic pressure to be applied to the secondary control line.

6. The valve of claim 5, wherein:

said signal is transmitted hydraulically.

7. The valve of claim 5, wherein:

said signal is transmitted electronically.

8. The valve of claim 5, wherein:

said signal is transmitted wirelessly.

9. The valve of claim 5, wherein:

said signal is applied manually.

10. The valve of claim 1, wherein:

application of pressure to said primary control line leaves said valve member stationary in said first position of said valve.

11. The valve of claim 1, wherein:

said valve member is retained in said first position of said valve with a breakable retainer or a bias force.

12. The valve of claim 1, wherein:

said valve member is retained in said second position against return to said first position after initial movement of said valve member to said second position.

13. The valve of claim 1, wherein:

said valve member is movable between said first and second positions with no more hydraulic lines than said primary and secondary control lines running to said valve member from the remote location.

14. The valve of claim 13, wherein:

said valve member is movable between said first and second positions with no auxiliary power lines running to said valve member from the remote location.

15. A valve for engaging a backup hydraulic system to operate a subterranean tool from a primary hydraulic system, comprising:

a subterranean tool having a movable member actuated by a primary piston or a secondary piston;

a valve member having two inlets to respectively connect a primary control line and a secondary control line that each extend to the tool from a remote location;

said valve member movable from a first position where said primary control line is in flow communication with said primary piston to a second position where said secondary control line is in communication with said secondary piston by application of pressure in one of said control lines;

application of pressure to said secondary control line moves said valve member to said second position;

application of pressure to said secondary control line moves said valve member, such that pressure applied to said primary control line acts on opposed sides of said primary piston.

16. The valve of claim 15, wherein:

application of pressure to said secondary control line moves said valve member such that said secondary control line is put into fluid communication with said secondary piston.

17. The valve of claim 16, wherein:

said valve member is in pressure balance from opposed hydrostatic pressures in said primary and secondary control lines.

18. The valve of claim 17, wherein:

said valve member further comprises a plurality of seals with a primary and a secondary leak paths respectively associated with said valve member, said leak paths extend through said valve member or outside said valve member through jumper lines to selectively place equal pressure on opposed sides of said primary or secondary piston for operation of said tool to a failsafe position depending on the location of said seal that fails.

19. The valve of claim 18, wherein:

application of pressure in said secondary control line puts a force imbalance on said valve member to move said valve member to take a primary valve member seal out of a respective seal bore with the result being pressure in said primary control line communicating to opposed sides of said primary piston through said primary leak path.

20. The valve of claim 19, wherein:

application of pressure in said secondary control line puts a force imbalance on said valve member to move said valve member to take a secondary valve member seal out of a respective seal bore with the result being pressure in said secondary control line being put into fluid communication with said secondary piston.

21. The valve of claim 18, wherein:

application of pressure in said secondary control line puts a force imbalance on said valve member to move said valve member to take a secondary valve member seal out of a respective seal bore with the result being pressure in said secondary control line being put into fluid communication with said secondary piston.

22. The valve of claim 17, wherein:

said pressure balance arises from a mirror image arrangement of seal pairs on said valve member that each pair respectively straddles said primary and secondary control lines so that opposing equal forces cancel each other out.

* * * * *